US009903573B2

(12) United States Patent
Ito

(10) Patent No.: US 9,903,573 B2
(45) Date of Patent: Feb. 27, 2018

(54) LIGHTING EQUIPMENT

(71) Applicant: Hideaki Ito, Maebashi (JP)

(72) Inventor: Hideaki Ito, Maebashi (JP)

( * ) Notice: Subject to any disclaimer, the term of this patent is extended or adjusted under 35 U.S.C. 154(b) by 315 days.

(21) Appl. No.: 14/858,429

(22) Filed: Sep. 18, 2015

(65) Prior Publication Data

US 2017/0003008 A1 Jan. 5, 2017

(30) Foreign Application Priority Data

Jul. 3, 2015 (JP) ..... 2015-134463

(51) Int. Cl.

| | |
|---|---|
| ***F21V 21/30*** | (2006.01) |
| ***F21V 33/00*** | (2006.01) |
| ***F21V 21/22*** | (2006.01) |
| ***F21V 21/15*** | (2006.01) |
| *F21W 131/10* | (2006.01) |

(52) U.S. Cl.

CPC ..... *F21V 21/30* (2013.01); *F21V 21/15* (2013.01); *F21V 21/22* (2013.01); *F21V 33/0064* (2013.01); *F21W 2131/1005* (2013.01)

(58) Field of Classification Search

CPC ..... F21V 21/34; F21V 21/35

See application file for complete search history.

(56) References Cited

U.S. PATENT DOCUMENTS

| | | | | |
|---|---|---|---|---|
| 2,345,382 A * | 3/1944 | Cramer | F21S 2/00 | 362/232 |
| 6,022,130 A * | 2/2000 | Donato | F21S 8/038 | 362/427 |
| 2003/0230331 A1* | 12/2003 | Li | A45B 3/04 | 362/7 |
| 2014/0085889 A1* | 3/2014 | Mackiewicz | F21S 8/038 | 362/249.1 |

FOREIGN PATENT DOCUMENTS

JP 5433613 B2 3/2014

* cited by examiner

*Primary Examiner* — Elmito Breval

(74) *Attorney, Agent, or Firm* — Westerman, Hattori, Daniels & Adrian, LLP

(57) ABSTRACT

A lighting equipment including illuminating lamps that automatically turn outward when an illuminating portion supporting the lamps is directed directly downward at an elevation angle of −90°. When the elevation angle of the illuminating portion is at a predetermined angle or more, the elevation angle of the illuminating lamps is maintained at substantially 0°, and the normal direction of the illuminating portion substantially matches the irradiation directions of the illuminating lamps. The elevation angle of the illuminating lamps is varied and maintained by link mechanisms mechanically interlocking with the pivoting of illuminating arm portions.

4 Claims, 9 Drawing Sheets

LIGHTING EQUIPMENT

TECHNICAL FIELD

The present invention relates to lighting equipment to be used mainly at an outdoor construction site and for rescue operations, etc.

BACKGROUND ART

At a construction site, during relief and rescue operations, and firefighting, etc., at night, lighting equipment that illuminates a worksite is essential. The degree of freedom of the light irradiation direction of lighting equipment to be used for these activities is preferably as high as possible. In this regard, the inventors of the present application developed an invention relating to a variable direction type support device described in [Patent Document 1] listed below which can freely change the irradiation direction of illumination upward, downward, rightward, and leftward by installing lighting equipment thereon. In addition, the inventors developed an invention described in [Japanese Patent Application No. 2014-97454] relating to a raising and lowering device with illumination capable of changing the irradiation direction of illumination upward, downward, rightward, and leftward.

CITATION LIST

Patent Document

[Patent Document 1] Japanese Published Examined Patent Application No. 5433613

SUMMARY OF THE INVENTION

Problem to be Solved by the Invention

For further improvement in light amount of lighting equipment, use of multi-lamp lighting equipment with multiple illuminating lamps is desirable. The irradiation directions of the illuminating lamps of such multi-lamp lighting equipment are generally set to the same direction to irradiate a number of lights toward a distant object. However, there is a problem that with this lighting equipment, when the light irradiation direction is directed directly downward to illuminate a worksite, only the area directly below the lighting equipment is illuminated, and the worksite cannot be widely illuminated.

The present invention was developed in view of the circumstances described above, and an object thereof is to provide lighting equipment with illuminating lamps that automatically turn outward in a state where the lighting equipment is at an elevation angle of −90° at which the light irradiation direction is directed directly downward.

Means for Solving the Problem

The present invention solves the above-described problem by providing:

(1) Lighting equipment 100 including an illuminating portion 90 with four illuminating lamps 20*a*, 20*b*, 20*a*', and 20*b*' the elevation angles of which are variable, wherein when the illuminating portion 90 is at an elevation angle of −90° at which the illuminating portion 90 is directed directly downward, the illuminating lamps 20*a* to 20*b*' turn outward at a predetermined elevation angle θ with respect to the direction of the illuminating portion 90, and the elevation angles of the illuminating lamps 20*a* to 20*b*' increase or decrease in the range of θ to 0° in inverse proportion to an increase or decrease in elevation angle of the illuminating portion 90 until the elevation angles of the illuminating portion 90 reach a predetermined angle, and when the elevation angle of the illuminating portion 90 is a predetermined angle or more, the elevation angles of the illuminating lamps 20*a* to 20*b*' are maintained at substantially 0° and the normal direction of the illuminating portion 90 substantially matches the irradiation directions of the illuminating lamps 20*a* to 20*b*'.

(2) The lighting equipment 100 according to (1) described above, wherein the illuminating portion 90 includes a base portion 30 rotatable in the horizontal direction, illuminating arm portions 40 and 40' that are mounted one each on the two side surfaces opposed to each other of the base portion 30, rotate coaxially right and left, and have both end faces 40*a*, 40*b*, 40*a*', and 40*b*' being at approximately 45° to their long-side directions, illuminating lamps 20*a* to 20*b*' mounted on both end faces 40*a* to 40*b*' of the illuminating arm portions 40 and 40' so that their elevation angles are variable, link mechanisms 50 provided one each for the illuminating arm portions 40 and 40' and vary the elevation angles of both illuminating lamps 20*a* to 20*b*' mounted on both end faces 40*a* to 40*b*' of the illuminating arm portions 40 and 40', wherein the elevation angles of the illuminating lamps 20*a* to 20*b*' vary by mechanically interlocking with rotations of the illuminating arm portions 40 and 40'.

(3) The lighting equipment 100 according to (2) described above, wherein one link mechanism 50 includes a rotary cylinder (first rotary cylinder 84, second rotary cylinder 84') that rotates the illuminating arm portion 40, 40', a fixed shaft 82 coaxial with the rotary cylinder, a fixed link plate 52 that is fixed to the fixed shaft 82 and has an arm 52*a* with a predetermined length, a first link 54 one end of which is connected to the arm 52*a* of the fixed link plate 52, a three-point plate 60 one point of which is axially supported rotatably on the illuminating arm portion 40, 40', to another point of which the other end of the first link 54 is connected, and to the other one point of which a second link 55*a* and a third link 55*b* are connected, a second link 55*a* the other end of which extends toward one end face 40*a*, 40*a*' of the illuminating arm portion 40, 40', a third link 55*b* the other end of which extends toward the other end face 40*b*, 40*b*' of the illuminating arm portion 40, 40', a first link plate 62*a* that is mounted rotatably on the one end face 40*a*, 40*a*', and connected to the other end of the second link 55*a*, a second link plate 62*b* that is mounted rotatably on the other end face 40*b*, 40*b*', and connected to the other end of the third link 55*b*, a first tilt bar 64*a* that rotates together with the first link plate 62*a* and has an arm with a predetermined length, a second tilt bar 64*b* that rotates together with the second link plate 62*b* and has an arm with a predetermined length, a first tilt link 56*a* one end of which is connected to the arm of the first tilt bar 64*a*, a second tilt link 56*b* one end of which is connected to the arm of the second tilt bar 64*b*, a first tilt stay 66*a* that is fixed to the illuminating lamp 20*a*, 20*a*' mounted on one end face 40*a*, 40*a*' of the illuminating arm portion 40, 40' and bent into a substantially L-shape the tip end portion of which is connected to the other end of the first tilt link 56*a*, and a second tilt stay 66*b* that is fixed to the illuminating lamp 20*b*, 20*b*' mounted on the other end face 40*b*, 40*b*' of the illuminating arm portion 40, 40' and bent into a substantially L-shape the tip end portion of which is connected to the other end of the second tilt link 56*b*, wherein according to rotations of the illuminating arm portions 40 and 40', the three-point plates 60 rotate, the second links 55*a* and the third links 55*b* connected to the three-point plates 60 move in substantially the same direction, the first link plates 62*a* and the second link plates 62*b* rotate respectively and push and pull the tip sides bent into substantially L-shapes of the first tilt stays 66*a* and the second tilt stays 66*b* to vary the elevation angles of the illuminating lamps 20*a* to 20*b*' on both end faces 40*a* to 40*b*' by equal amounts, respectively.

(4) The lighting equipment 100 according to (3) described above, wherein a vertical fixed shaft 14 coaxial with the rotation axis in the horizontal direction of the base portion 30 and the fixed shaft 82 of the illuminating arm portions 40 and 40' are joined in a T-shape, and the rotary shaft portion 80 of the illuminating arm portions 40 and 40' includes a first rotary cylinder 84 that is connected to one illuminating arm portion 40 and inserted on the fixed shaft 82, a second rotary cylinder 84' that is connected to the other illuminating arm portion 40' and inserted on the fixed shaft 82, and a connecting bar 86 that joins the first rotary cylinder 84 and the second rotary cylinder 84', where the connecting bar 86 is fixed to circumferential surfaces of portions of the first rotary cylinder 84 and the second rotary cylinder 84', and further includes a tilt limiting means that limits the rotation ranges of the first rotary cylinder 84 and the second rotary cylinder 84' to prevent the connecting bar 86 from coming into contact with the vertical fixed shaft 14.

Effect of the Invention

Lighting equipment according to the present invention has illuminating lamps that automatically turn outward when the lighting equipment is at a directly downward illuminating position with an elevation angle of −90° at which the light irradiation direction is directed directly downward. Therefore, a worksite can be widely illuminated without special operations.

BEST MODE FOR CARRYING OUT THE INVENTION

Figure 1:
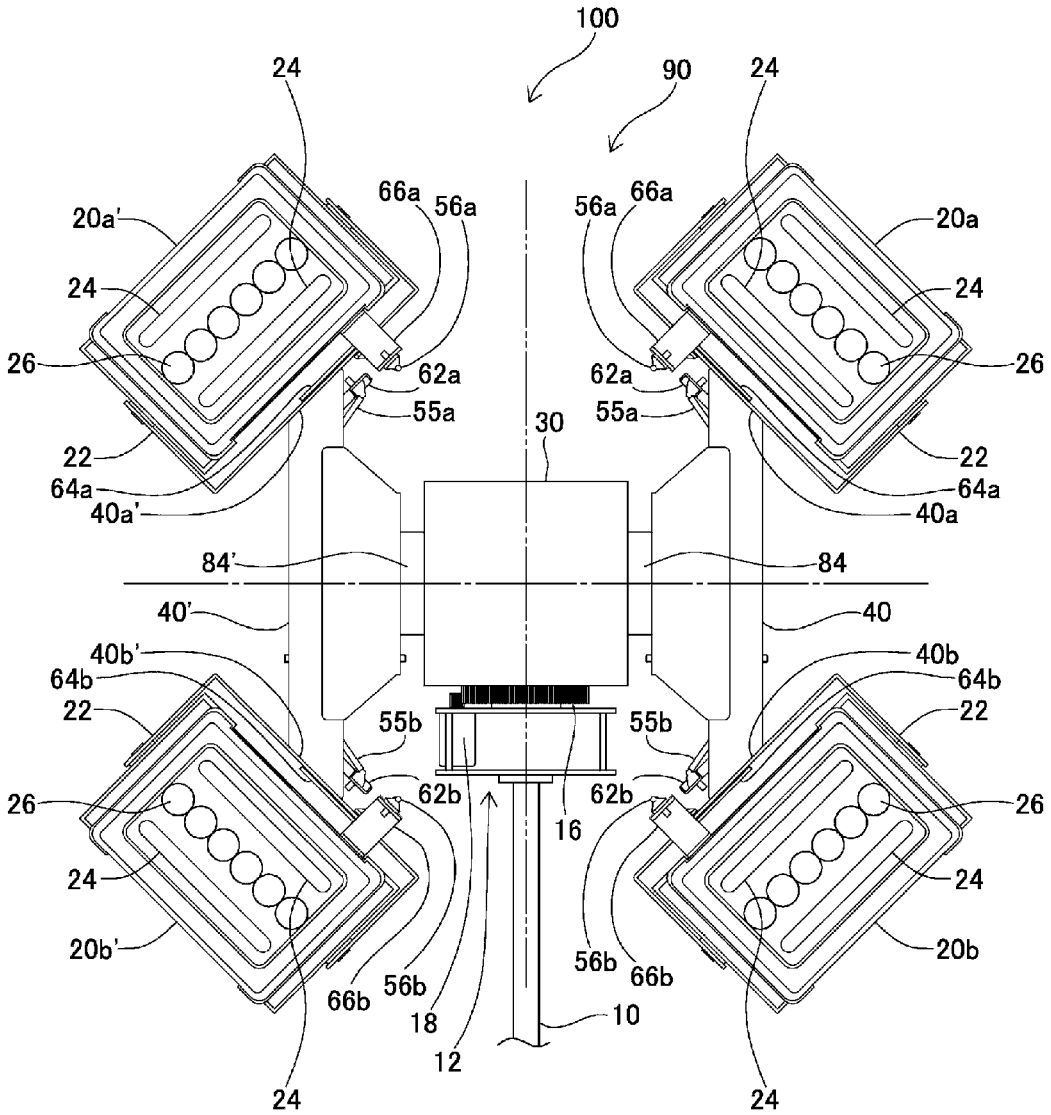
FIG. 1 is a front view of lighting equipment according to the present invention.
Figure 2:
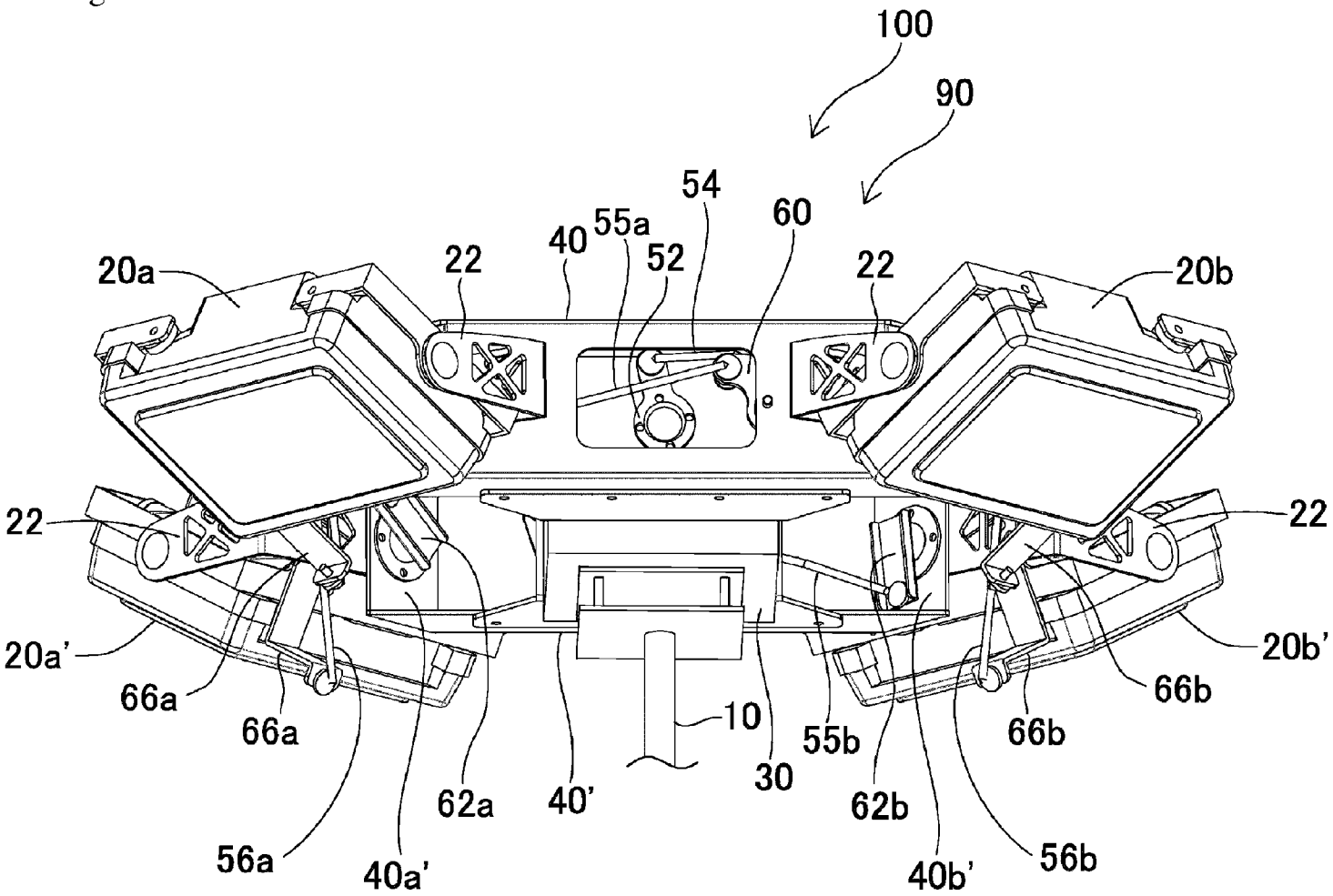
FIG. 2 is a perspective view of the lighting equipment according to the present invention when it is at a directly downward illuminating position.

An embodiment of lighting equipment 100 according to the present invention is described based on the drawings. Here, FIG. 1 is a front view of the lighting equipment 100 according to the present invention when an illuminating portion 90 is at an elevation angle of 0° (directed toward the horizontal direction). FIG. 2 is a perspective view when the illuminating portion 90 of the lighting equipment 100 according to the present invention is at an elevation angle of −90° (directly downward illuminating position at which the illuminating portion 90 is directed directly downward). The lighting equipment 100 according to the present invention is assumed to be installed on a special-purpose vehicle such as a fire truck and work by obtaining power from the vehicle. However, the vehicle on which the lighting equipment is installed is not limited to this, and the lighting equipment may be installed on a construction vehicle or other vehicles. In addition, the lighting equipment may also be mounted on a cart or base, etc., and used.

First, the lighting equipment 100 according to the present invention includes an illuminating portion 90 and a post portion 10. The illuminating portion 90 includes a base portion 30 connected to the post portion 10, illuminating arm portions 40 and 40' mounted one each on the two side surfaces opposed to each other of the base portion 30, illuminating lamps 20*a*, 20*b*, 20*a*', and 20*b*' mounted on the respective end faces 40*a*, 40*b*, 40*a*' and 40*b*' of the illuminating arm portions 40 and 40' so that their elevation angles are variable, and link mechanisms 50 that are provided one each for the illuminating arm portions 40 and 40' to vary the elevation angles of the illuminating lamps 20*a* to 20*b*'. The link mechanisms 50 are described in detail later. The end faces 40*a* to 40*b*' of the illuminating arm portions 40 and 40' are at angles of substantially 45° to the long-side directions of the illuminating arm portions 40 and 40', and the illuminating lamps 20*a* to 20*b*' are mounted via illuminating lamp stays 22 fixed to the end faces 40*a* to 40*b*', respectively. Further, the lighting equipment 100 includes a rotation mechanism 12 that rotates the illuminating portion 90 in the horizontal direction (direction horizontal with respect to the post portion 10). In this example, the rotation mechanism 12 is provided at the connecting portion between the post portion 10 and the base portion 30, however, the configuration of the rotation mechanism 12 is not especially limited to this.

The post portion 10 holds the illuminating portion 90 at a predetermined height, a post portion that is manually or electrically raised and lowered is preferably used, and it is particularly preferable that the post portion 10 is formed into a pipe and cables to be connected to the respective portions of the illuminating portion 90 are inserted inside the pipe and connected to an operation panel and a power supply located below.

The four illuminating lamps 20*a*, 20*b*, 20*a*', and 20*b*' are preferably disposed radially at even intervals, and therefore, right and left illuminating arm portions 40 and 40' are formed so that the illuminating lamps 20*a* to 20*b*' are positioned symmetrically to each other with respect to both of the axis shown by the alternate long and short dash line and the axis shown by the alternate long and short two dashes line in FIG. 1.

Figure 3A:
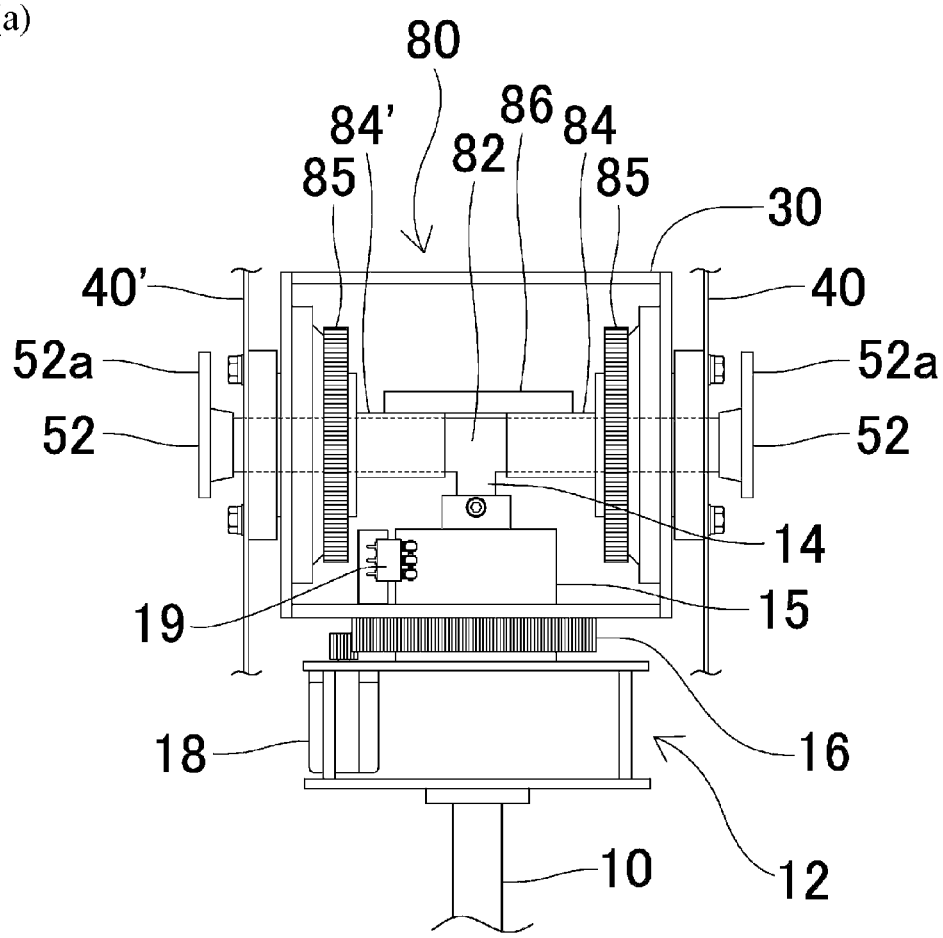
FIGS. 3(*a*) and 3(*b*) are schematic views showing the interior of the base portion of the lighting equipment according to the present invention.
Figure 3B:
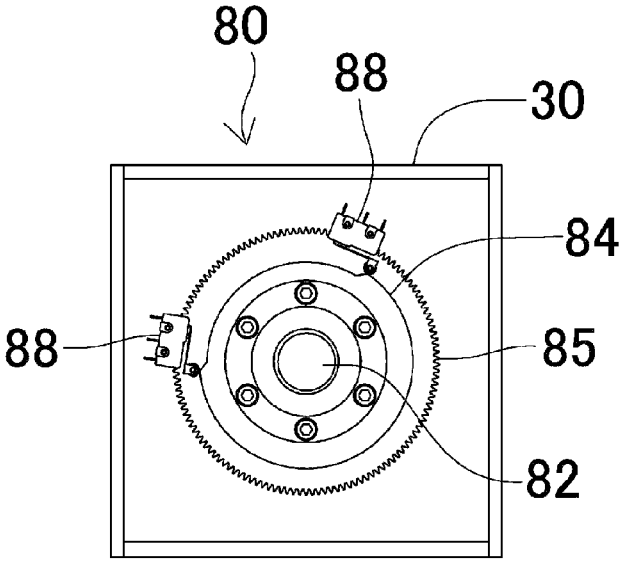

Next, an example of the preferable rotation mechanism 12 of the lighting equipment 100 is described with reference to FIG. 3(*a*). FIG. 3(*a*) is a schematic view showing the interior of the base portion 30. The rotation mechanism 12 preferable for the lighting equipment 100 shown in FIG. 3(*a*) includes a horizontal rotary gear 16 fixed to the bottom surface of the base portion 30, and a horizontal rotary motor 18 connected to the horizontal rotary gear 16. When a user performs an operation to pan the lighting equipment 100 by using the operation panel, etc., the horizontal rotary motor 18 rotates, and according to this, the horizontal rotary gear 16 rotates and the base portion 30 rotates together with the illuminating arm portions 40 and 40'. Accordingly, the illuminating portion 90 rotates in the horizontal direction, and the lighting equipment 100 pans. The rotation mechanism 12 may be provided with a horizontal direction detection means that detects the irradiation direction of the illuminating portion 90 (direction of the base portion 30). With this configuration, according to signals from the horizontal direction detection means, the rotation range of the illuminating portion 90 can be limited and the illuminating portion 90 can be automatically positioned in a specific direction set in advance. Here, a preferable example of the horizontal direction detection means is shown. A preferable horizontal direction detection means of the lighting equipment 100 according to the present invention includes a fixed cylinder 15 that is fixed to the post portion 10 side and has a mark such as a concavity or convexity marked at a predetermined position on the circumferential surface, and a pan sensor 19 that comes into sliding contact with the circumferential surface of the fixed cylinder 15. When the base portion 30 is rotated by the horizontal rotary motor 18, the pan sensor 19 rotates and moves along the circumferential surface of the fixed cylinder 15 and detects the mark on the circumferential surface of the fixed cylinder 15. Then, according to a signal from this pan sensor 19, the direction of the illuminating portion 90 is recognized, and predetermined pan control is performed for the illuminating portion 90.

Next, a preferable example of the rotary shaft portion 80 that rotates the illuminating arm portions 40 and 40' is described. First, in the base portion 30, a fixed shaft 82 that penetrates two side surfaces opposed to each other is provided. On this fixed shaft 82, a first rotary cylinder 84 connected to one illuminating arm portion 40 and a second rotary cylinder 84' connected to the other illuminating arm portion 40' are inserted movably. Circumferential surfaces of portions of the first rotary cylinder 84 and the second rotary cylinder 84' are fixed by a connecting bar 86, and by this connecting bar 86, the first rotary cylinder 84 and the second rotary cylinder 84' are joined. The fixed shaft 82 is partially exposed between the first rotary cylinder 84 and the second rotary cylinder 84'. The rotary shaft portion 80 is provided with a vertical fixed shaft 14 coaxial with the horizontal rotary gear 16, that is, coaxial with the rotation axis in the horizontal direction of the base portion 30, and this vertical fixed shaft 14 and the fixed shaft 82 are joined in a T-shape at the exposed portion between the first rotary cylinder 84 and the second rotary cylinder 84'. Thus, by joining the vertical fixed shaft 14 in the vertical direction and the fixed shaft 82 in the horizontal direction in a T-shape, torsion and eccentricity are suppressed at the time of pivoting of the illuminating arm portions 40 and 40' and panning of the illuminating portion 90, and rotating operations of the respective portions of the illuminating portion 90 can be smoothly performed.

For each of the first rotary cylinder 84 and the second rotary cylinder 84', a rotary gear 85 is formed, and to this rotary gear 85, a tilt motor (not shown) is connected. When tilt motors rotate, the rotary gears 85 rotate, and accordingly, the first rotary cylinder 84 and the second rotary cylinder 84' rotate and the illuminating arm portions 40 and 40' pivot with the same phase in the same direction. At this time, the fixed shaft 82 inserted in the first rotary cylinder 84 and the second rotary cylinder 84' does not rotate.

In the case where the vertical fixed shaft 14 and the fixed shaft 82 are joined in a T-shape, there is a possibility that the connecting bar 86 collides with the vertical fixed shaft 14 due to rotations of the first rotary cylinder 84 and the second rotary cylinder 84'. Therefore, it is preferable that the first rotary cylinder 84 or the second rotary cylinder 84' is provided with a tilt limiting means that limits the rotation ranges of the first rotary cylinder 84 and the second rotary cylinder 84'. This tilt limiting means has, for example, as shown in FIG. 3(*b*), a configuration in which a mark such as a step, a concavity or convexity, etc., is provided at a predetermined position on the circumferential surface of the first rotary cylinder 84 or the second rotary cylinder 84', a detecting member 88 that detects this mark is provided, and the rotation ranges of the first rotary cylinder 84 and the second rotary cylinder 84' are limited according to a signal from this detecting member 88.

Figure 4:
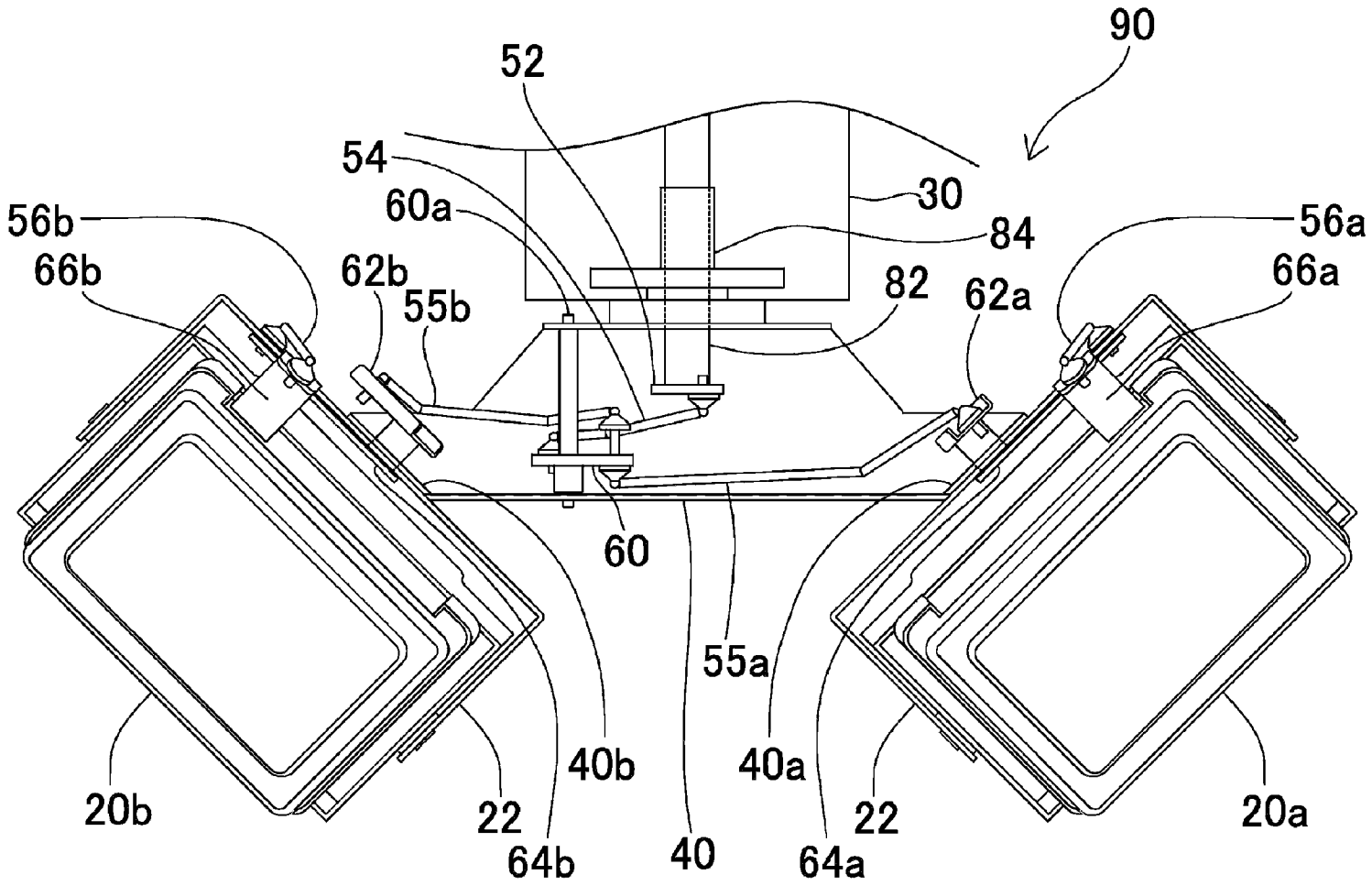
FIG. 4 is a schematic configuration diagram of a link mechanism viewed from immediately below of the lighting equipment according to the present invention when it is at the directly downward illuminating position.
Figure 5:
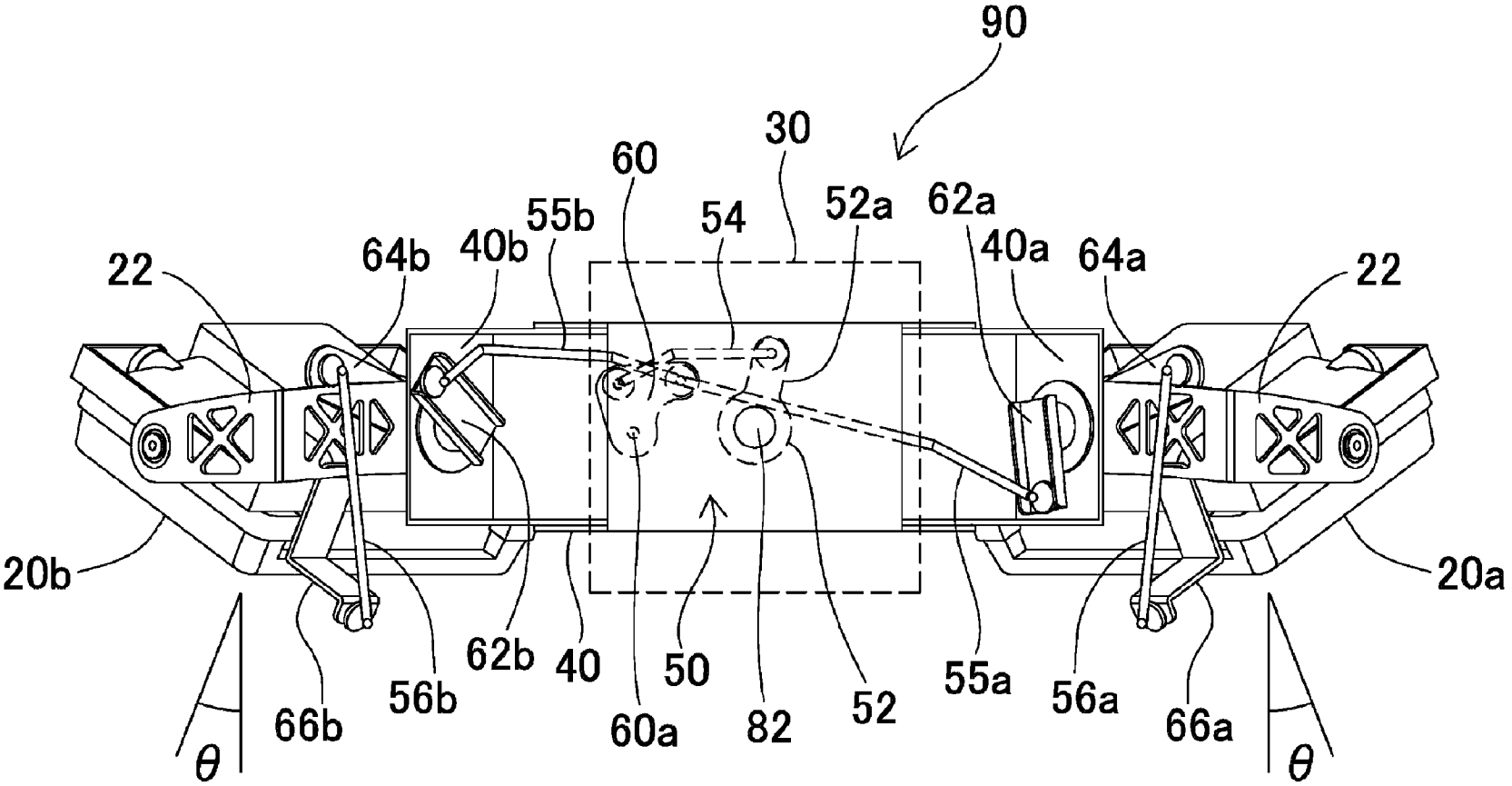
FIG. 5 is a schematic configuration diagram of the link mechanism of the lighting equipment according to the present invention when it is at the directly downward illuminating position.
Figure 6:
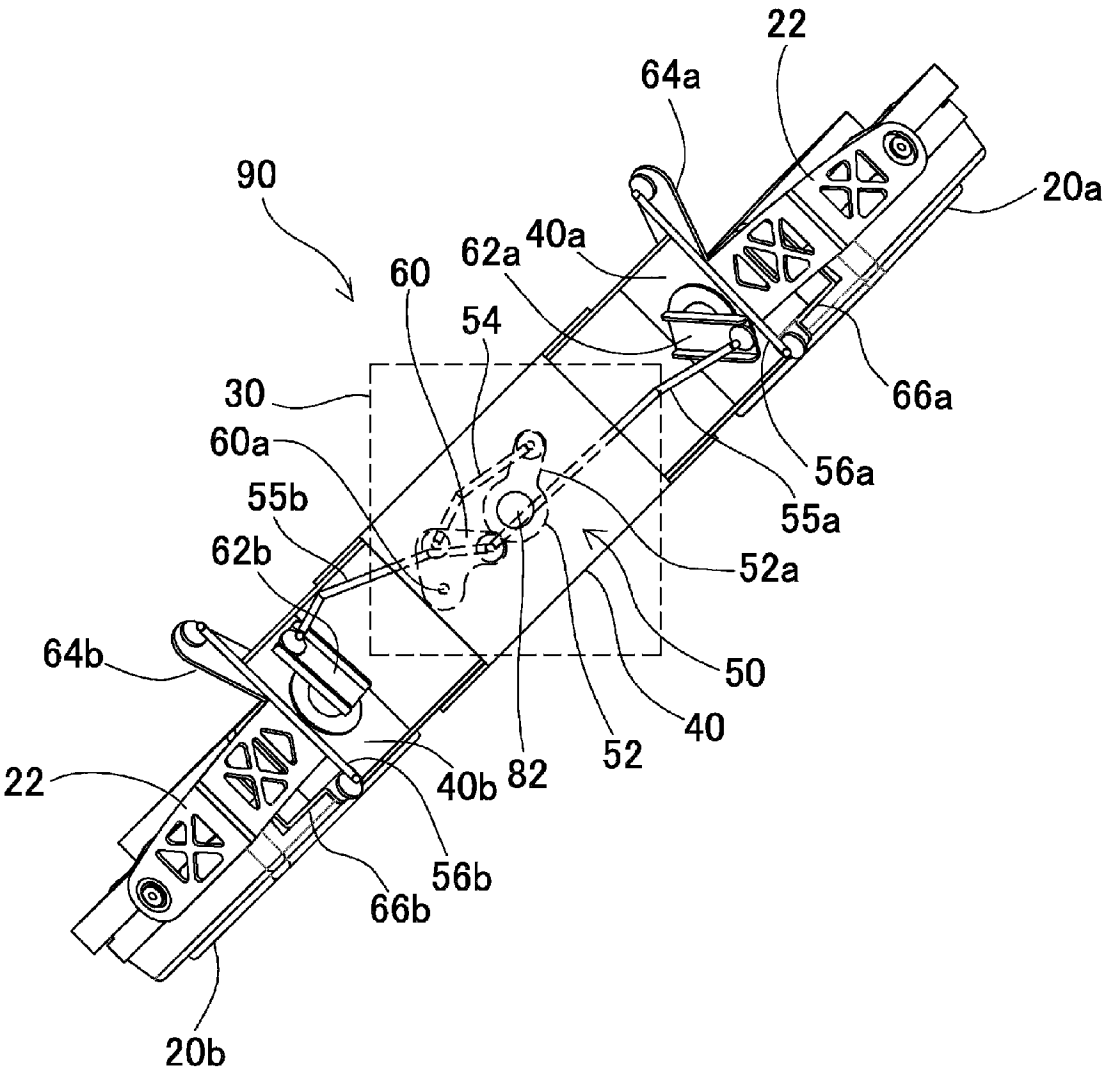
FIG. 6 is a schematic configuration diagram of the link mechanism of the lighting equipment according to the present invention when the lighting equipment is at an elevation angle of −45°.
Figure 7:
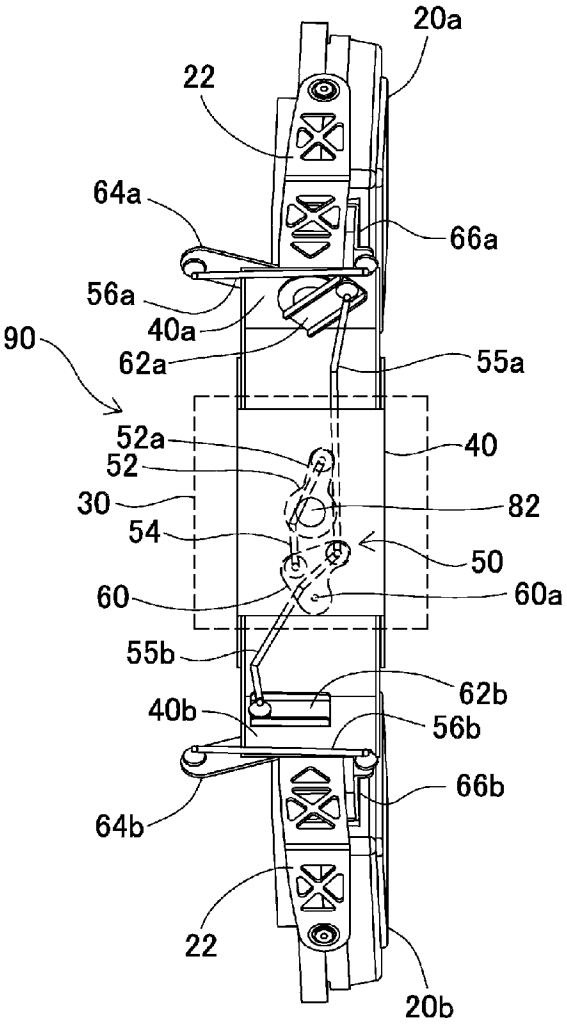
FIG. 7 is a schematic configuration diagram of the link mechanism of the lighting equipment according to the present invention when the lighting equipment is at an elevation angle of 0°.
Figure 8A:
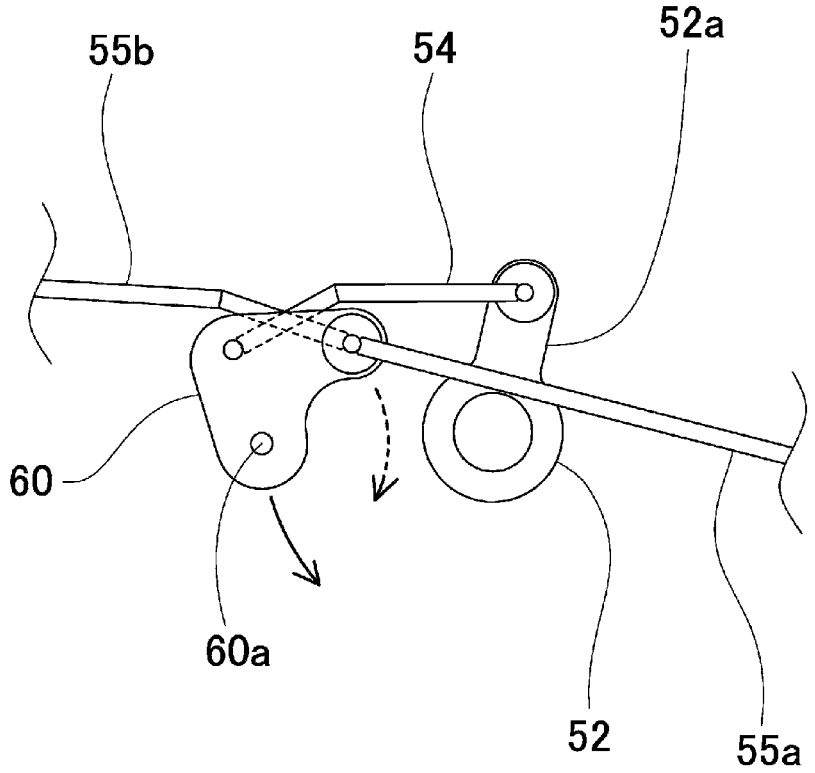
FIGS. 8(*a*) and 8(*b*) are partial enlarged views of the link mechanism of the lighting equipment according to the present invention.
Figure 8B:
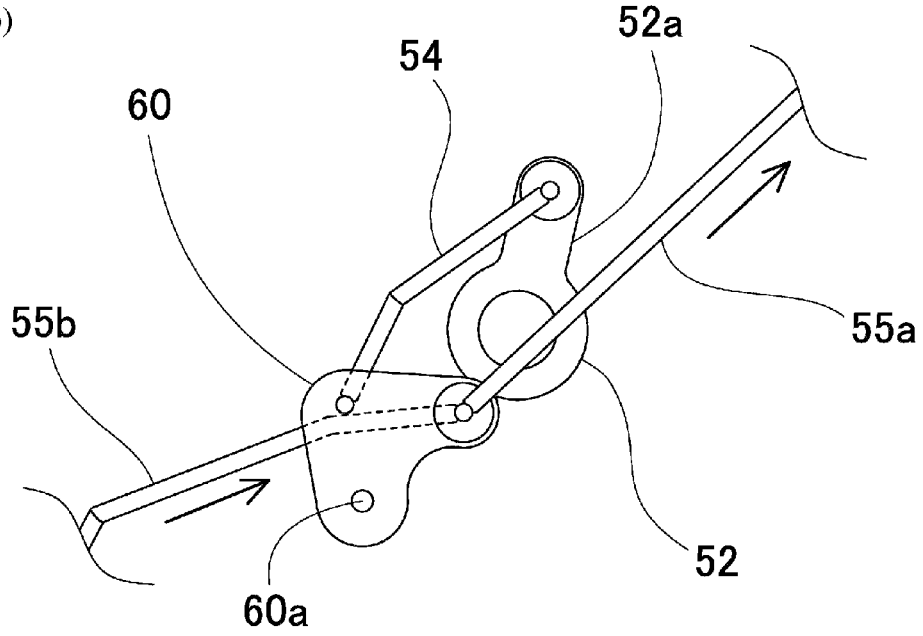

Next, the configuration and operation of the link mechanism 50 of the lighting equipment 100 is described with reference to FIG. 4 to FIG. 8. Here, FIG. 4 is a schematic configuration diagram of the link mechanism 50 of one illuminating arm portion 40 viewed from immediately below when it is at the directly downward illuminating position. FIG. 5 is a schematic configuration diagram of the link mechanism 50 viewed from the base portion 30 side when it is at the directly downward illuminating position. FIG. 6 is a schematic configuration diagram of the link mechanism 50 viewed from the base portion 30 side when the illuminating portion 90 is at an elevation angle of −45°. FIG. 7 is a schematic configuration diagram of the link mechanism 50 viewed from the base portion 30 side when the illuminating portion 90 is at an elevation angle of 0° (directed toward the horizontal direction). FIG. 8 are partial enlarged views of the link mechanisms 50 shown in FIG. 5 and FIG. 6. The link mechanism 50 of the illuminating arm portion 40 and the link mechanism 50 of the illuminating arm portion 40' are configured symmetrically to each other, and their operations are the same. Here, the configuration and operation of one illuminating arm portion 40 is described.

First, as shown in FIG. 4, to one illuminating arm portion 40, the first rotary cylinder 84 that rotates around the fixed shaft 82 is fixed. According to rotation of the first rotary cylinder 84, the illuminating arm portion 40 pivots around the fixed shaft 82. The fixed shaft 82 is inserted in the illuminating arm portion 40, and as shown in FIG. 4 to FIG. 7, fixed to a fixed link plate 52 having an arm 52*a* with a predetermined length. Therefore, the direction of the fixed link plate 52 and the arm 52*a* is always constant and does not change regardless of pivoting of the illuminating arm portion 40. To the arm 52*a* of the fixed link plate 52, one end of a first link 54 with a predetermined length is connected movably. Both ends of the first link 54 and a second link 55*a*, a third link 55*b*, a first tilt link 56*a*, and a second tilt link 56*b* which are described later are connected respectively by, for example, ball joints, etc., that can move three-dimensionally. Further, the link mechanism 50 has a three-point plate 60 one point of which is axially supported on the illuminating arm portion 40 by a shaft pin 60*a*. To another point of the three-point plate 60, the other end of the first link 54 is connected. To the other one point of the three-point plate 60, one end of the second link 55*a* extending toward one end face 40*a* and one end of the third link 55*b* extending toward the other end face 40*b* are connected. To avoid contact between the second link 55*a* and the third link 55*b*, it is preferable that, as shown in FIG. 4, they are connected to the front surface side and back surface side of the three-point plate 60, respectively, and bent at a predetermined angle to excellently transmit the rotation of the three-point plate 60 to the first link plate 62*a* and the second link plate 62*b*.

The other end of the second link 55*a* is connected to the arm of the first link plate 62*a* mounted rotatably on one end face 40*a* of the illuminating arm portion 40. The other end of the third link 55*b* is connected to the arm of the second link plate 62*b* mounted rotatably on the other end face 40*b* of the illuminating arm portion 40. To the first link plate 62*a*, the first tilt bar 64*a* that rotates together with the first link plate 62*a* and has an arm with a predetermined length is fixed. To the second link plate 62*b*, the second tilt bar 64*b* that rotates together with the second link plate 62*b* and has an arm with a predetermined length is fixed. To the bottom surface of the illuminating lamp 20*a*, the first tilt stay 66*a* the front surface side of which is bent into a substantially L-shape toward the base portion 30 side is fixed, and the tip side of the bent first tilt stay 66*a* and the tip side of the arm of the first tilt bar 64*a* are joined by the first tilt link 56*a*. To the bottom surface of the illuminating lamp 20*b*, the second tilt stay 66*b* the front surface side of which is bent into a substantially L-shape toward the base portion 30 side is fixed, and the tip side of the bent second tilt stay 66*b* and the tip side of the arm of the second tilt bar 64*b* are joined by the second tilt link 56*b*.

Lengths and angles, etc., of these components of the link mechanisms 50 are appropriately designed to optimum values according to the dimensions of the respective portions constituting the illuminating portion 90 and the value of the elevation angle θ required for the illuminating lamps 20*a* to 20*b*', etc. However, the first tilt bar 64*a*, the first tilt link 56*a*, and the first tilt stay 66*a*, and the second tilt bar 64*b*, the second tilt link 56*b*, and the second tilt stay 66*b* are configured so as to become axisymmetric to each other with respect to the axis of the fixed shaft 82. On the other hand, the angle between the first link plate 62*a* and the first tilt bar 64*a* and the angle between the second link plate 62*b* and the second tilt bar 64*b* are individually set to appropriate angles. The phase difference between the first link plate 62*a* and the second link plate 62*b* is approximately 120°, and when the second link 55*a* and the third link 55*b* are moved by the three-point plate 60, the first link plate 62*a* and the second link plate 62*b* connected to these links rotate in directions opposite to each other.

Next, operation of the link mechanism 50 is described. First, when the illuminating portion is at the directly downward illuminating position shown in FIG. 5, the tip ends of the arms of the first tilt bar 64*a* and the second tilt bar 64*b* are positioned in the very front side. Accordingly, the tip sides of the first tilt stay 66*a* and the second tilt stay 66*b* bent into L-shapes are pressed forward via the first tilt link 56*a* and the second tilt link 56*b*, and the illuminating lamps 20*a* and 20*b* turn outward around the holding shafts of the illuminating lamp stays 22. At this time, the elevation angle θ of the illuminating lamps 20*a* and 20*b* with respect to the direction of the illuminating portion 90 is preferably 20° to 40°, and most preferably 30°.

Next, when the elevation angle of the illuminating portion 90 is increased from the state at the directly downward illuminating position shown in FIG. 5 to the state shown in FIG. 6 or FIG. 7, a user performs a tilting operation by using the operation panel, etc. Accordingly, the tilt motors inside the base portion 30 rotate, and via the rotary gears 85, the first rotary cylinder 84 and the second rotary cylinder 84' rotate. When the first rotary cylinder 84 rotates, the illuminating arm portions 40 and 40' fixed to the first rotary cylinder 84 and the second rotary cylinder 84' pivot in a direction to increase the elevation angle of the illuminating portion 90 (counterclockwise in FIG. 5 to FIG. 7) around the fixed shaft 82. At this time, the fixed link plates 52 fixed to the fixed shaft 82 do not change regardless of the rotating operation of the illuminating arm portions 40 and 40' as shown in FIG. 8(*a*) and FIG. 8(*b*). However, the three-point plates 60 mounted on the illuminating arm portions 40 and 40' revolve around the fixed shaft 82 according to rotation of the illuminating arm portions 40 and 40' as shown by the solid arrow in FIG. 8(*a*). At this time, the rotation of the three-point plate 60 is limited by the first link 54 connected to the fixed link plate 52, and as a result, the three-point plate 60 spins in the direction shown by the dashed-line arrow in FIG. 8(*a*) around the shaft pin 60*a* while revolving around the fixed shaft 82. When the illuminating portion is at a position near the directly downward illuminating position, the arm 52*a* of the fixed link plate 52 is in a direction substantially perpendicular to the lines between the shaft pin 60*a* and the fixed shaft 82, and in this region, the displacement amounts of the arm 52*a* and the three-point plate 60 are comparatively large. According to turning of the three-point plate 60, both of the second link 55*a* and the third link 55*b* connected to the other one point of the three-point plate 60 move to the illuminating lamp 20*a* side as shown by the arrows in FIG. 8(*b*). Then, according to this movement of the second link 55*a*, the first link plate 62*a* is pressed and rotates counterclockwise in FIG. 5. Accordingly, the first tilt bar 64*a* fixed to the first link plate 62*a* also rotates counterclockwise, and the arm of the first tilt bar 64*a* moves to the back surface side of the illuminating portion 90. Accordingly, the tip side of the first tilt stay 66*a* is pulled via the first tilt link 56*a* and the elevation angle of the illuminating lamp 20*a* decreases from the angle θ. According to movement of the third link 55*b*, the second link plate 62*b* is pulled and rotates clockwise in FIG. 5. Accordingly, the second tilt bar 64*b* fixed to the second link plate 62*b* also rotates clockwise, and the arm of the second tilt bar 64*b* moves to the back surface side of the illuminating portion 90. Accordingly, the tip side of the second tilt stay 66*b* is pulled via the second tilt link 56*b* and the elevation angle of the illuminating lamp 20*b* decreases from the angle θ. At this time, the variation in elevation angle of the illuminating lamp 20*b* is equal to that of the illuminating lamp 20*a*. The illuminating arm portion 40' also performs the above-described operation in the exact same manner, and accordingly, the elevation angles of the four illuminating lamps 20*a*, 20*b*, 20*a*', and 20*b*' of the illuminating portion 90 decrease in inverse proportion to an increase in elevation angle of the illuminating portion 90 (illuminating arm portions 40 and 40').

Then, when the illuminating portion 90 reaches a predetermined elevation angle, the elevation angles of the illuminating lamps 20*a* to 20*b*' become 0°, and the normal direction of the illuminating portion 90 substantially matches the irradiation directions of the illuminating lamps 20*a* to 20*b*'. It is preferable that the variation in elevation angle of the illuminating portion 90 (illuminating arm portions 40 and 40') and the variation in elevation angle of the illuminating lamps 20*a* to 20*b*' are set to be equal to each other. That is, they are preferably configured so that, in the case where the elevation angles θ of the illuminating lamps 20*a* to 20*b*' at the directly downward illuminating position are 30°, the elevation angles of the illuminating lamps 20*a* to 20*b*' become 0° when the illuminating arm portions 40 and 40' pivot 30°.

Then, when the elevation angle of the illuminating portion 90 is further increased from the state shown in, for example, FIG. 6 where the elevation angles of the illuminating lamps 20*a* to 20*b*' are 0°, the illuminating arm portions 40 and 40' are caused to further pivot by the tilt motors. However, in this region, the arms 52*a* of the fixed link plates 52 are positioned at the sides opposite to the shaft pins 60*a* across the fixed shaft 82, and the displacement amounts of the three-point plates 60 with respect to pivoting of the illuminating arm portions 40 and 40' are small. Therefore, the second links 55*a* and the third links 55*b* move little, and the elevation angles of the illuminating lamps 20*a* to 20*b*' are maintained at nearly 0°. The range of variation of the elevation angle of the illuminating portion 90 is, for example, from the directly downward illuminating position (−90°) to approximately 130°, and a change in elevation angle beyond this range is limited by the above-described tilt limiting means.

When the elevation angle of the illuminating portion 90 is decreased from this state, the elevation angles of the illuminating lamps 20*a* to 20*b*' are maintained at nearly 0° until the elevation angle of the illuminating portion 90 reaches a predetermined angle. Then, when the elevation angle of the illuminating portion 90 decreases from the predetermined angle, the amount of displacement of the three-point plate 60 increases, and the second link 55*a* and the third link 55*b* connected to the three-point plate 60 moves to the illuminating lamp 20*b* side. Due to this movement of the second link 55*a*, the first link plate 62*a* is pulled and rotates clockwise in FIG. 6. Accordingly, the first tilt bar 64*a* also rotates clockwise, and the arm of the first tilt bar 64*a* moves to the irradiating surface side of the illuminating portion 90. Accordingly, the tip side of the first tilt stay 66*a* is pressed via the first tilt link 56*a*, and the elevation angle of the illuminating lamp 20*a* increases from 0°. In addition, due to the movement of the third link 55*b*, the second link plate 62*b* is pressed and rotates counterclockwise in FIG. 6. Accordingly, the second tilt bar 64*b* also rotates counterclockwise, and the arm of the second tilt bar 64*b* moves to the irradiating surface side of the illuminating portion 90. Accordingly, the tip side of the second tilt stay 66*b* is pressed via the second tilt link 56*b*, and the elevation angle of the illuminating lamp 20*b* increases from 0°. The illuminating arm portion 40' on the opposite side also performs the above-described operation in the exact same manner, and therefore, the elevation angles of the four illuminating lamps 20*a*, 20*b*, 20*a*', and 20*b*' of the illuminating portion 90 increase in inverse proportion to a decrease in elevation angle of the illuminating portion 90 (illuminating arm portions 40 and 40'). Then, the illuminating arm portions 40 and 40' are stopped by the tilt limiting means when reaching the directly downward illuminating position shown in FIG. 5. At this time, the illuminating lamps 20*a* to 20*b*' turn outward at an elevation angle θ with respect to the direction of the illuminating portion 90 and illuminate the surrounding of the illuminating portion 90.

Figure 9:
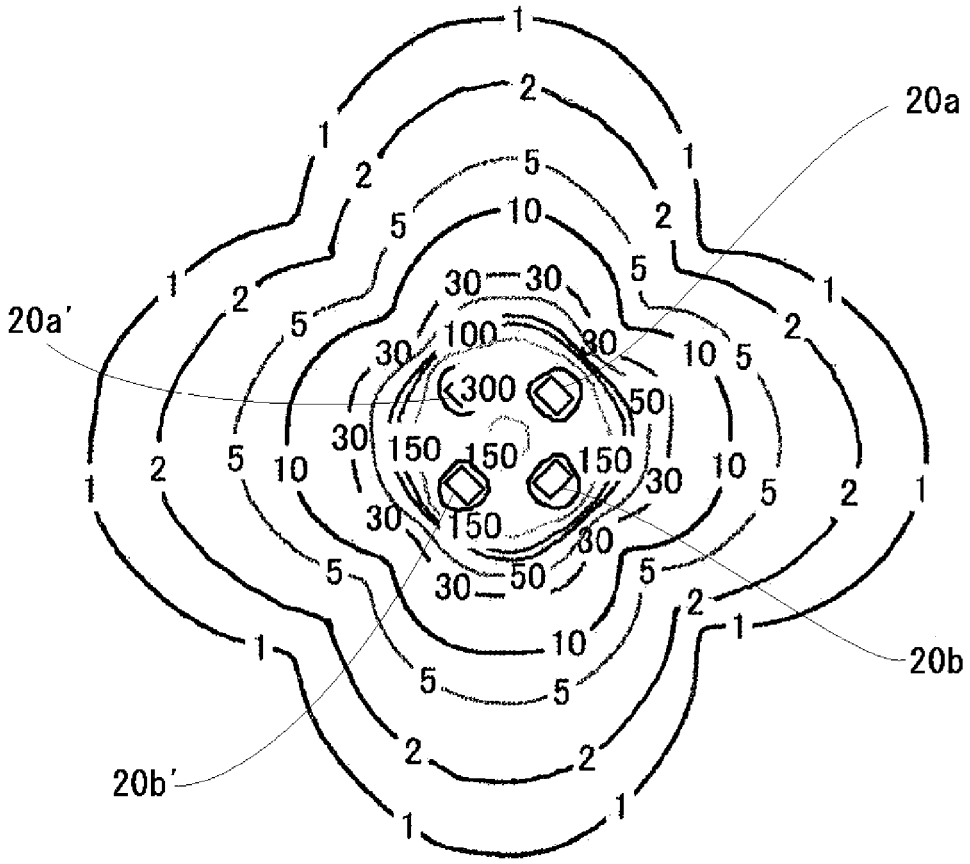
FIG. 9 shows illuminance distribution simulation results of the lighting equipment according to the present invention.

Each of the illuminating lamps 20*a*, 20*b*, 20*a*', and 20*b*' preferably includes, as shown in FIG. 1, an illuminating means 26 that illuminates the orthogonal direction, and a long lamp 24 the light of which is distributed in the lateral direction. With this configuration, as shown in the illuminance distribution simulation results in FIG. 9, the illuminating light from the illuminating portion 90 is distributed in a cross direction so that the central portion is superimposed, and the illuminance of the central portion can be increased at the time of distant irradiation. From the viewpoint of energy-saving, high-illuminance LEDs are preferably used as the illuminating means 26 and the long lamp 24.

As described above, in the lighting equipment 100 according to the present invention, when the illuminating portion 90 is at the directly downward illuminating position with an elevation angle of −90°, the illuminating lamps 20*a*, 20*b*, 20*a*', and 20*b*' automatically turn outward. Accordingly, a worksite can be widely illuminated. In the region in which the elevation angle of the illuminating portion 90 is a predetermined angle or more, the elevation angles of the illuminating lamps 20*a* to 20*b*' are maintained at substantially 0° and the normal direction of the illuminating portion 90 substantially matches the irradiation directions of the illuminating lamps 20*a* to 20*b*'. Accordingly, the illuminating portion 90 can illuminate a distant object with a high illuminance. The elevation angles of the illuminating lamps 20*a* to 20*b*' are varied and maintained by the link mechanisms 50 that vary the elevation angles of the illuminating lamps 20*a* to 20*b*' according to rotations of the illuminating arm portions 40 and 40', by mechanically interlocking with pivoting of the illuminating arm portions 40 and 40'. Accordingly, it becomes possible that the elevation angles of the illuminating lamps 20*a* to 20*b*' are varied by only the tilt motors that cause the illuminating arm portions 40 and 40' to pivot, and therefore, reduction in component cost and high operation stability are realized.

The shapes, dimensions, and configurations, etc., of the lighting equipment 100, the illuminating portion 90, the link mechanisms 50, and other components shown in this example are just examples, and the present invention can be modified and carried out without departing from the scope of the present invention.

REFERENCE SIGNS LIST

14 Vertical fixed shaft
20*a*, 20*b*, 20*a*', 20*b*' Illuminating lamp
30 Base portion
40, 40' Illuminating arm portion
40*a*, 40*a*' One end face
40*b*, 40*b*' Other end face
50 Link mechanism

52 Fixed link plate
52*a* Arm (of fixed link plate)
54 First link
55*a* Second link
55*b* Third link
56*a* First tilt link
56*b* Second tilt link
60 Three-point plate
62*a* First link plate
62*b* Second link plate
64*a* First tilt bar
64*b* Second tilt bar
66*a* First tilt stay
66*b* Second tilt stay
80 Rotary shaft portion
84 First rotary cylinder
84' Second rotary cylinder
86 Connecting bar
82 Fixed shaft
90 Illuminating portion
100 Lighting equipment

The invention claimed is:

1. A Lighting equipment comprising an illuminating portion supported on a post portion, the illuminating portion supporting four illuminating lamps, wherein an elevation angle of the illuminating lamps is with respect to a normal direction of the illuminating portion, an elevation angle of the illuminating portion is with respect to the post portion, the elevation angle of the illuminating lamps and the elevation angle of the illuminating portion are variable, when the elevation angle of the illuminating portion is at −90° at which the illuminating portion is directed directly downward, the illuminating lamps turn outward at a predetermined elevation angle θ, the elevation angle of the illuminating lamps increase or decrease in the range of 0 to 0° in inverse proportion to an increase or decrease in the elevation angle of the illuminating portion until the elevation angle of the illuminating portion reaches a predetermined angle, and when the elevation angle of the illuminating portion is at the predetermined angle or more, the elevation angle of the illuminating lamps are maintained at substantially 0° and the normal direction of the illuminating portion substantially matches the irradiation direction of the illuminating lamps.

2. The lighting equipment according to claim 1, wherein the illuminating portion includes:

a base portion supported on the post portion and rotatable in a plane orthogonal to the post portion;

illuminating arm portions, that are mounted one each on two side surfaces opposed to each other on the base portion, rotate coaxially right and left, and have both end faces being at approximately 45° to their long-side directions, the illuminating lamps being mounted on both of the end faces of the illuminating arm portions so that the elevation angle of the illuminating lamps is variable; and link mechanisms, provided one each for the illuminating arm portions, vary the elevation angle of the illuminating lamps mounted on both of the end faces of the illuminating arm portions, wherein the elevation angle of the illuminating lamps vary by mechanically interlocking with rotations of the illuminating arm portions.

3. The lighting equipment according to claim 2, wherein one link mechanism includes:

a rotary cylinder that rotates the illuminating arm portion;

a fixed shaft coaxial with the rotary cylinder;

a fixed link plate that is fixed to the fixed shaft and has an arm with a predetermined length;

a first link having one end connected to the arm of the fixed link plate;

a three-point plate having a first point axially supported rotatably on the illuminating arm portion, a second point connected to the other end of the first link, and a third point connected to one end of a second link and to one end of a third link;

a second link having another end extending towards one end face of the illuminating arm portion;

a third link having another end extending towards the other end face of the illuminating arm portion;

a first link plate that is mounted rotatably on the one end face, and connected to the other end of the second link;

a second link plate that is mounted rotatably on the other end face, and connected to the other end of the third link;

a first tilt bar that rotates together with the first link plate and has an arm with a predetermined length;

a second tilt bar that rotates together with the second link plate and has an arm with a predetermined length;

a first tilt link having one end of connected to the arm of the first tilt bar;

a second tilt link having one end of connected to the arm of the second tilt bar;

a first tilt stay that is fixed to the illuminating lamp mounted on one end face of the illuminating arm portion and bent into a substantially L shaped tip end portion connected to the other end of the first tilt link; and a second tilt stay that is fixed to the illuminating lamp mounted on the other end face of the illuminating arm portion and bent into a substantially L shaped tip end portion connected to the other end of the second tilt link, wherein according to rotations of the illuminating arm portions, the three-point plates rotate, the second links and the third links connected to the three-point plates move in substantially the same direction, the first link plates and the second link plates rotate respectively and push and pull the tip end portion of the first tilt stay and the second tilt stay to vary the elevation angle of the illuminating lamps on both end faces by equal amounts, respectively.

4. The lighting equipment according to claim 3, wherein the post portion having a fixed shaft coaxial with the rotation axis of the base portion and the fixed shaft of the illuminating arm portions are joined in a T-shape, the rotary shaft portion of the illuminating arm portions includes a first rotary cylinder that is connected to one illuminating arm portion and inserted on the fixed shaft of the illuminating arm portions, a second rotary cylinder that is connected to the other illuminating arm portion and inserted on the fixed shaft of the illuminating arm portions, and a connecting bar that joins the first rotary cylinder and the second rotary cylinder, and the connecting bar is fixed to circumferential surfaces of portions of the first rotary cylinder and the second rotary cylinder, and further including a tilt limiting means that limits the rotation ranges of the first rotary cylinder and the second rotary cylinder to prevent the connecting bar from coming into contact with the fixed shaft of the post portion.

* * * * *